United States Patent [19]

Wu

[11] Patent Number: 4,948,945

[45] Date of Patent: Aug. 14, 1990

[54] ELECTRIC IRONING DEVICE WITH POWER SUPPLY CONNECTOR ARRANGEMENT PERMITTING EITHER CORDED OR CORDLESS OPERATION

[76] Inventor: Tsann-Kuen Wu, No. 140-10, Che-Lu-Chien, Pau-An Tsun, Jen-Te Hsiang, Tainan Hsien, Taiwan

[21] Appl. No.: 331,260

[22] Filed: Mar. 30, 1989

[51] Int. Cl.[5] ..... D06F 79/02; D06F 75/28; H05B 1/00

[52] U.S. Cl. ..... 219/247; 38/74; 38/82; 38/142; 219/242; 219/259; 248/117.2

[58] Field of Search ..... 219/245, 247, 259, 242; 248/117.1–117.7; 38/82, 88, 90, 74, 75, 141, 142

[56] References Cited

U.S. PATENT DOCUMENTS 4,815,992 3/1989 Aranzabal ..... 219/247 X

FOREIGN PATENT DOCUMENTS 210538 2/1987 European Pat. Off. ..... 219/247
2583792 12/1986 France ..... 219/247
63-49193 3/1988 Japan ..... 219/247
63-49198 3/1988 Japan ..... 219/247
2166458 5/1986 United Kingdom ..... 219/247
2179961 3/1987 United Kingdom ..... 219/247

*Primary Examiner*—Anthony Bartis
*Attorney, Agent, or Firm*—Marshall & Melhorn

[57] ABSTRACT

An ironing device includes an iron body having an electric heating element, a seat on which the iron can rest when not in use and a power supply cord terminating in a connector having a socket adapted to connect with prongs on the iron body for supplying power to the heating element. The connector is provided with a first releasable latch for detachably interlocking the connector with the iron body so that the iron can be used as a corded iron and a second releasable latch for detachably interlocking the connector to the seat so that the iron can be used as a cordless iron. The user can selectively interlock the connector to either the iron body or the seat by activating a button device on the seat which selectively releases either the first or second latch.

5 Claims, 6 Drawing Sheets

ELECTRIC IRONING DEVICE WITH POWER SUPPLY CONNECTOR ARRANGEMENT PERMITTING EITHER CORDED OR CORDLESS OPERATION

BACKGROUND OF THE INVENTION

This invention relates to an ironing device, and more particularly to an ironing device Which has an iron body, a connector with power cord and a seat having a button device mounted therein so that said ironing device can be used for ironing with either the iron body or the iron body connected to the connector.

A conventional ironing device has an iron body connected to a power cord or wires. The power cord or wires sometimes interfere with the operation of the iron body and thus inconvenience the user while ironing. Therefore, an improved ironing device has been developed in order to overcome the above defect. Such an improved ironing device has an iron body and prongs connected with a heating device in said iron body. The prongs are adapted to detachably plug into a receptacle for activating the heating device. Therefore, a user can use the iron body without a power cord or wires. However, the temperature of the iron body of the improved ironing device will decrease after the iron body separates from the receptacle and must be reheated after being used for a period of time. Hence, the improved ironing device is not suitable for use over an extended time period.

SUMMARY OF THE INVENTION

It is therefore a main object of this invention to provide an ironing device having an iron body which can be used to iron with or without a power cord depending upon the length of time which the ironing device is to be used by means of activating a button device.

Accordingly, an ironing device of this invention includes a connector having a socket fixed therein and a power cord connected to said socket. The connector is detachably interlocked with an iron body. The iron has an electrical heating device mounted therein and prongs electrically connected with said heating device, the prongs being adapted to detachably plug into the socket of the connector for activating said heating device A seat is detachably interlocked with the connector. Therefore, the ironing device can be used for cordless ironing with the iron body only when the connector is interlocked with the seat, and used for corded ironing with both the iron body and the connector when the iron body is interlocked with said connector. In this respect, the user can use the ironing device with or without a power cord. The improvement is characterized in that the ironing device has a button device for controlling either the connection between the iron body and the connector or the connection between the seat and the connector.

BRIEF DESCRIPTION OF THE DRAWINGS

Other features and advantages of this invention will become apparent in the following detailed description of a preferred embodiment of this invention with reference to the accompanying drawings, in which.

DETAILED DESCRIPTION OF A PREFERRED EMBODIMENT

Figure 1:
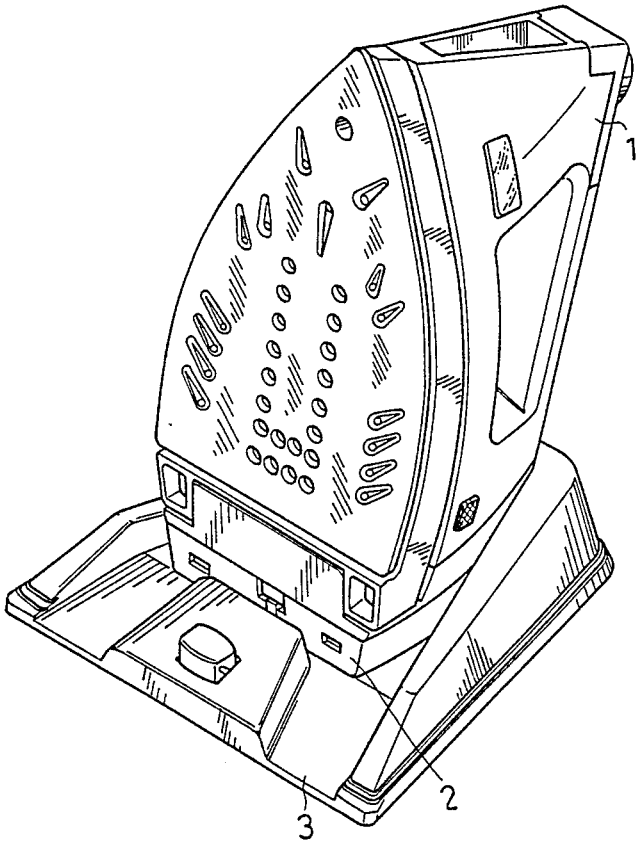
FIG. 1 is a perspective view of a preferred embodiment of an ironing device of this invention.
Figure 2:
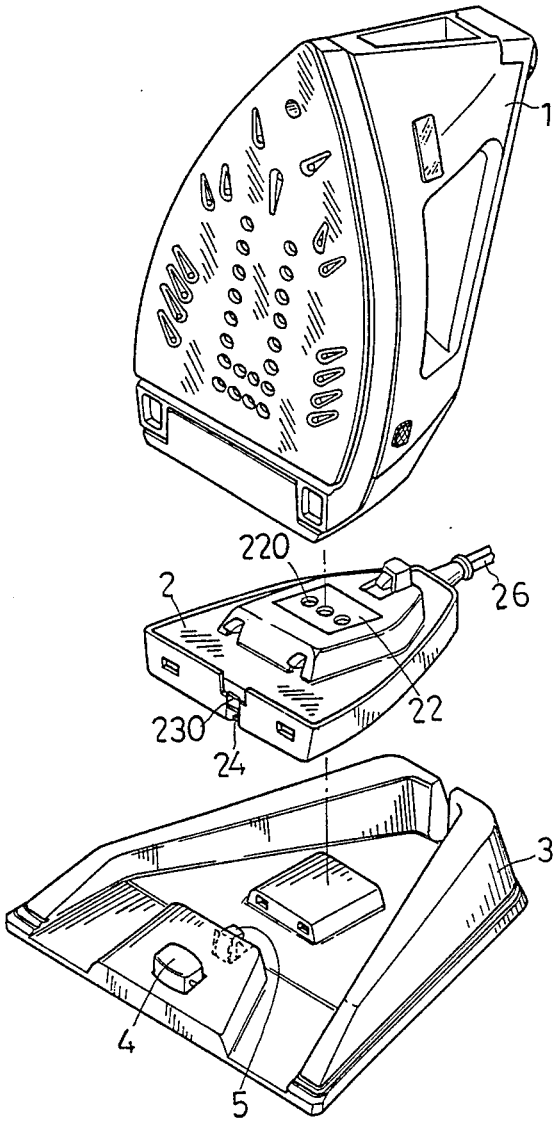
FIG. 2 is an exploded view of a preferred embodiment of an ironing device of this invention.

Referring to FIGS. 1 and 2, a perspective view and an exploded view of a preferred embodiment of an ironing device of this invention are shown. The ironing device includes an iron body 1, a connector 2 and a seat 3, which are detachably interlocked therebetween in a manner to be described later. The iron body 1 has an electrical heating device (not shown) mounted therein. The connector 2 has a socket 22 fixed therein and a power cord 26 connected to said socket 22.

Figure 3:
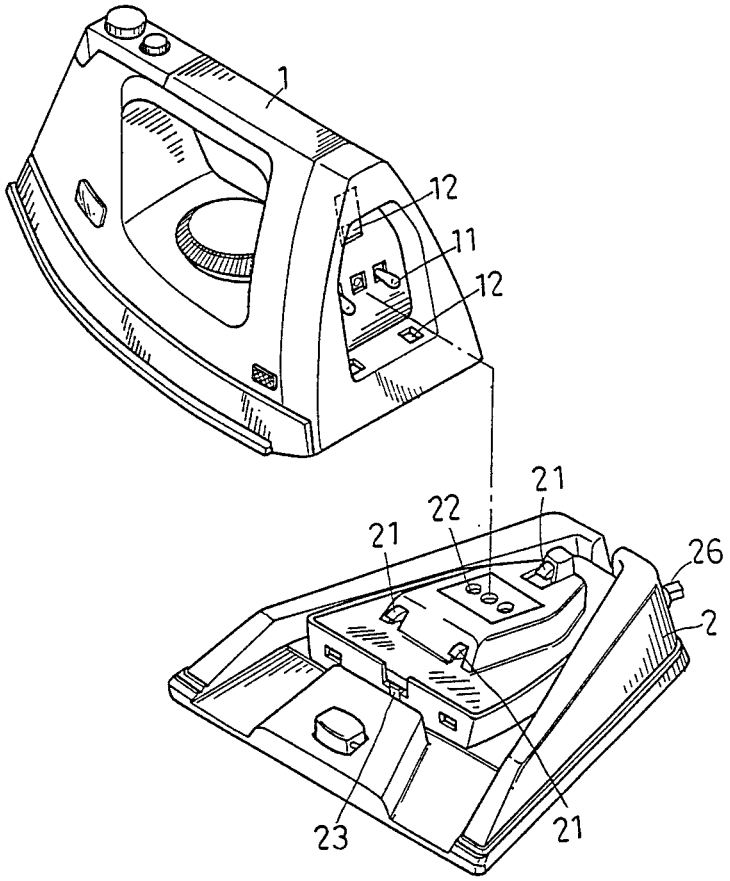
FIG. 3 is a perspective schematic view showing the ironing device of FIG. 1 in a first operative position

Referring to FIG. 3, the iron body 1 has a pair of prongs 11 protruding from the rear side thereof. The prongs 11 are electrically connected with the heating device mounted into the iron body 1 and adapted to detachably plug in the socket 22 of the connector 2 for the purpose of activating the heating device. Three slots 12 are formed on the rear side of the iron body 1, which may be correspondingly and detachably engaged with three upward hook members 21 that will be protruded out from the upper surface of the connector 2 in a manner to be described later.

Figure 4:
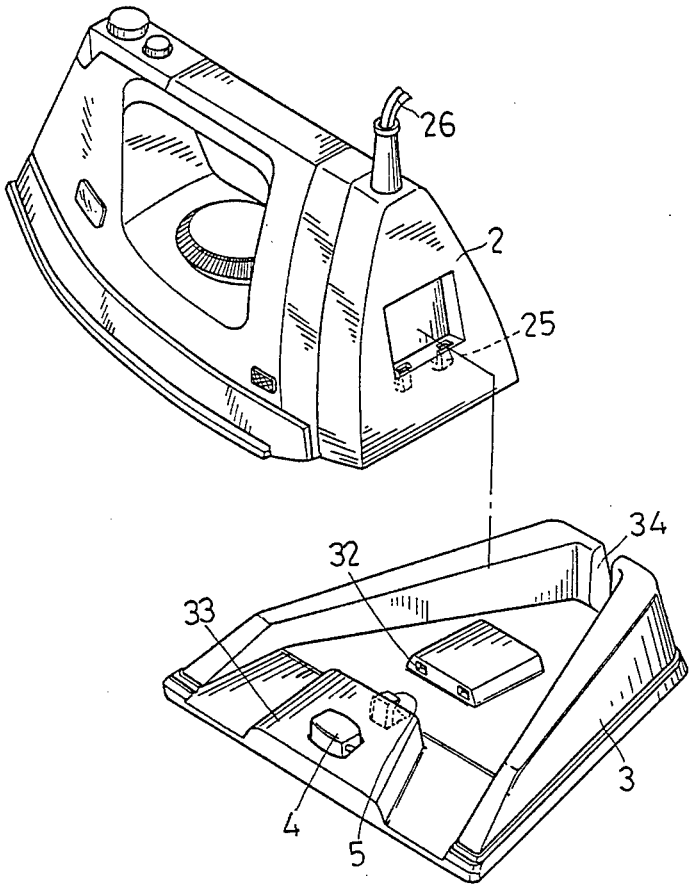
FIG. 4 is a perspective schematic view showing the ironing device of FIG. 1 in a second operative position.

Referring to FIG. 4, the connector 2 is interlocked with the iron body 1 and separates from the seat 3. The connector 2 has two downward hook members 25 to be protruded out from the bottom surface of said connector 2 so as to detachably engage with two slots 32 formed in the upper side of the seat 3 in a manner to be described later. The seat 3 has a button device mounted on the upper side thereof for controlling the connection of the iron body 1 and the connector 2 and the connection of said seat 3 and said connector 2 that will be described hereinafter.

Figure 6:
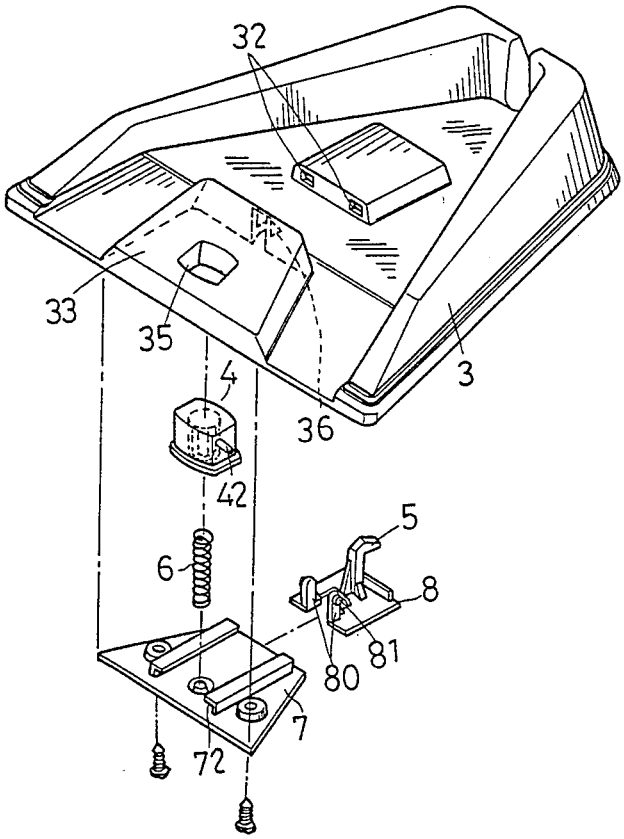
FIG. 6 is an exploded view of a seat of the ironing device of this invention.
Figure 7:
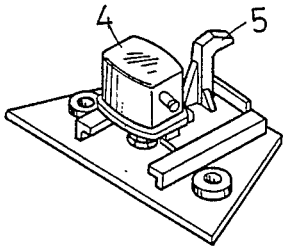
FIG. 7 is a perspective view of a button device of the seat of the ironing device according to this invention.

Referring to FIG. 6, the button device is mounted in a housing 33 projected from the seat 3 and includes a button 4 and a push rod 5 with a hooked end operatively associated with said button 4. The push rod 5 is fixed on a sliding plate 8. The sliding plate is slidably mounted on a bottom plate 7 between two guiding rails 72. The bottom plate 7 is screwed onto the bottom of the seat 3 so as to define the bottom of the housing 33. The button 4 is biased by a spring 6 so as to protrude out from a hole 35 formed in the upper side of the housing 33. Two opposed inclined slots 42 are respectively formed in two sides of the button 4. The sliding plate 8 has two posts 80 extended upwardly therefrom. Each free end of the posts 80 has a projection 81 slidably inserted in the slot 42 of the button 4 as best illustrated in FIG. 7. In this respect, the hooked end of the push rod 5 may protrude out from the housing 33 through a slot 36 when the button 4 is biased to a upwardly protruding position. Alternatively, the sliding plate 8 may move toward the button 4 when said button 4 is pressed downward so that the hooked end of the push rod 5 may move back into the housing 33.

Figure 5:
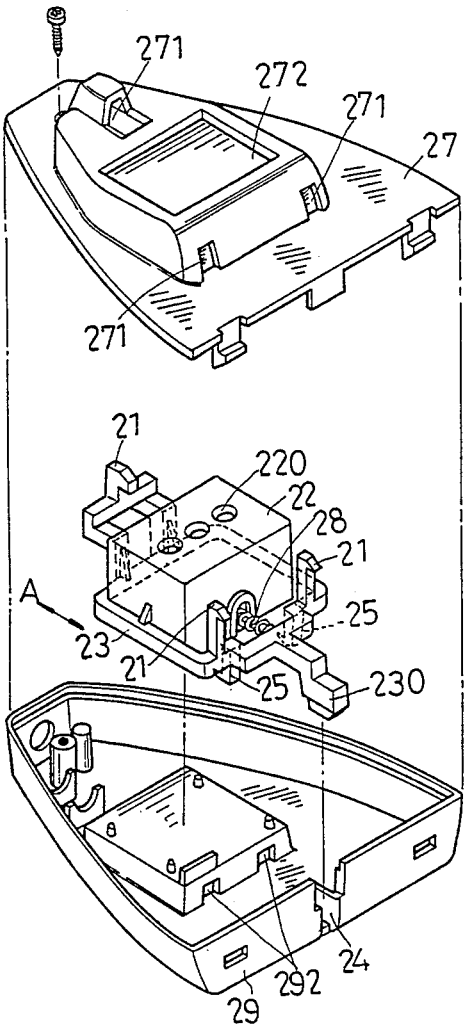
FIG. 5 is an exploded view of a connector of the ironing device of this invention

Referring now to FIG. 5, an exploded view of the connector 2 of this embodiment is shown. The connector 2 is designed as a case including an upper case body 27 and a lower case body 29 which are detachably engaged. The socket 22 is fixed into the connector 2. The plug holes 220 of the socket 22 are formed in the upper face of said socket 22 and are exposed to an opening 272 in the upper case body 27. A rectangular frame 23 is mounted around the socket 22 and is adapted to be slidably moved in a direction as indicated by arrow A. Three first hook members 21 are extended upwardly from the frame 23 and adapted to be engaged with the slots 12 of the iron body 1 by passing through three holes correspondingly formed in the upper case portion 27. Two second hook members 25 are extended downwardly from the frame 23 and adapted to be engaged with the slots 32 of the seat 3 by passing through two holes 292 correspondingly formed in the lower case portion 29. A spring 25 is connected between the frame 23 and the socket 22 so as to urge the frame 23 with an extension portion 230 to move toward a notch 24 formed in the lower case portion 29 and enable the free end of the extension portion 230 to reach the notch 24. In this position, the first hook members 21 will protrude out from the holes 271 of the upper case portion 27 but the the second hook members 25 will not protrude out from the holes 292 of the lower case portion 29. When the connector 2 is mounted to the seat 3, the free end of the extension 230 of the frame 23 will be pushed toward the socket 22 by the hooked end of the push rod 5 so that the first hook members 21 will not protrude out from the holes 271 of the upper case portion 27 but the second hook members 25 will protrude out from the holes 292 to interlock with the slots 32 of the seat 3, as best illustrated in FIG. 3. In this position, the iron body 1 is not interlocked with the connector 2 and thus can be separated from said connector 2. It is noted that the biasing pressure of the spring 25 is smaller than the counter pressure caused by the spring 6 of the button device. If the button 4 of the seat 3 is pressed, this enabling the push rod 5 to separate from the free end of the extension portion 230, the frame 23 will move to a position where the first hook members 21 protrude out from the holes 271 of the upper case portion 27 and the second hook members 25 disengage with the slots 32 of the seat 3. In this position, the iron body 1 can be interlocked with the connector when the first hook members 21 engages with the slots 12 of the iron body 1, as best illustrated in FIG. 4. Therefore, the user can select either the the seat 3 or the iron body 1 to be interlocked with the connector by the button 4. In this way, by activating the button device, the ironing device of this invention can either be used with just the iron body 1 or with the iron body 1 connected with the connector 2 and a power cord 26.

With this invention thus explained, it is apparent that numerous modifications and variations can be made without departing from the scope and spirit of this invention. It is therefore intended that this invention be limited only as indicated in the appended claims.

I claim:

1. An ironing device comprising:

a power supply connector having a socket fixed therein and a power cord connected to said socket;

an iron body having an electrical heating device mounted therein and prongs electrically connected with said heating device, said prongs being adapted to detachably plug into said socket of said connector for activating said heating device, said connector including first releasable latching means cooperating with said iron body and detachably interlocking said connector with said iron body;

a seat adapted to be detachably interlocked with said connector, said connector including second releasable latching means adapted to cooperate with said seat for detachably interlocking said connector to said seat; whereby said ironing device can be used for ironing with said iron body only when said connector is interlocked with said seat, and ironing with said iron body and said connector when said iron body is interlocked with said connector by said first latching means; and a button device mounted to said seat and arranged to cooperate with said first and second latching means to selectively establish either the interlocked connection between said iron body and said connector or the interlocked connection between said seat and said connector.

2. An ironing device as claimed in claim 1, wherein said second latching means on said connector includes a plurality of first hook members adapted to engage with a plurality of first slots correspondingly formed in said seat in a first locking position.

3. An ironing device as claimed in claim 2, wherein said first latching means includes a plurality of second hook members adapted to engage with a plurality of second slots correspondingly formed in said iron body in a second locking position.

4. An ironing device as claimed in claim 3, wherein said first and second hook members are associated with a rectangular frame, said frame being slidably mounted around said socket of said connector and having a coil spring connected to said socket of said connector so as to urge said frame to said second locking position wherein said connector and said body are interlocked.

5. An ironing device as claimed in claim 4, wherein said button device comprises a button and a push rod operatively associated with said button, said push rod being adapted to push said frame of said connector to said first locking position when said button is unpressed whereby said connector is locked with said seat and to separate from said frame so as to let said coil spring to urge said frame to said second locking position when said button is pressed.

* * * * *